US006960104B1

(12) United States Patent
Lwee

(10) Patent No.: US 6,960,104 B1
(45) Date of Patent: Nov. 1, 2005

(54) CARD CONNECTOR CAPABLE OF AVOIDING ERRONEOUS INSERTION OF CARD

(75) Inventor: Nai Hock Lwee, Singapore (SG)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/023,439

(22) Filed: Dec. 29, 2004

(30) Foreign Application Priority Data

Nov. 23, 2004 (TW) ..... 93218815 U

(51) Int. Cl.[7] ..... H01R 24/00
(52) U.S. Cl. ..... 439/630
(58) Field of Search ..... 439/630, 377, 439/325–326, 377.1, 60, 946, 924.1, 489, 439/159–160, 636, 660; 361/685, 818, 724–727, 361/677–687

(56) References Cited

U.S. PATENT DOCUMENTS 6,264,506 B1 * 7/2001 Yasufuku et al. ..... 439/638
6,623,305 B2 * 9/2003 Chun-Lung ..... 439/630
6,896,523 B2 * 5/2005 Nishizawa et al. ..... 439/60
6,896,555 B1 * 5/2005 Su et al. ..... 439/630
6,900,982 B2 * 5/2005 Chang et al. ..... 361/685
6,902,407 B2 * 6/2005 Ito et al. ..... 439/60

* cited by examiner

*Primary Examiner*—J. F. Duverne
(74) *Attorney, Agent, or Firm*—Bacon & Thomas PLLC

(57) ABSTRACT

A card connector is comprised of a base, a stop member, an elastic member, and at least one retaining tongue. The base bilaterally includes two lateral frames and a plurality of terminals. The stop member is pivotably mounted to the two lateral frames for pivoting movement between a stopping position and an entrance position. The elastic member is mounted between one of said lateral frames and said stop member. The retaining tongue includes a retaining portion for movement between a releasing position and a retaining position by insertion or extraction of the card, thereby optionally jamming the stop member, namely, while the card is correctly inserted, the card can pass through the stop member; while the card is incorrectly inserted, the stop member stops the card from entrance to further protect the terminals from damage resulted from the impact of the card.

6 Claims, 10 Drawing Sheets

CARD CONNECTOR CAPABLE OF AVOIDING ERRONEOUS INSERTION OF CARD

BACKGROUND OF THE INVENTION

1. Field of the Invention

The present invention relates generally to electronic devices, and more particularly to a card connector that avoids an electronic card from incorrect insertion to further protect the terminals from damage.

2. Description of the Related Art

There is a conventional card connector compatible with an electronic card, for example, a CF (compact flash) card. Since the CF card is rectangular in shape to have two long sides and two short sides and its access end is located at one of the two long sides, the user tends to carelessly rotate the card for an angle of 90° and then insert it into the card connector. If it happens, as shown in FIG. 10, the card 99 will impact the terminals 79 mounted inside the card connector 70 at the edge thereof and may incur deformation or even fracture of the terminals to further damage and disable the card connector.

SUMMARY OF THE INVENTION

The primary objective of the present invention is to provide an improved card connector, which allows a card to pass while the card is correctly inserted and stops the card while the card is incorrectly inserted, thereby protecting terminals of the card connector from deformation or damage.

The foregoing objective of the present invention is attained by the improved card connector, which is comprised of a base, a stop member, an elastic member, and at least one retaining tongue. The base bilaterally includes two lateral frames and a plurality of terminals. The stop member is pivotably mounted to the two lateral frames for pivoting movement between a stopping position and an entrance position. The elastic member is mounted between one of said lateral frames and said stop member. The retaining tongue includes a retaining portion for movement between a releasing position and a retaining position by insertion or extraction of the card, thereby optionally jamming the stop member. In other words, while the card is correctly inserted into the card connector, the card can pass by the stop member; while the card is incorrectly inserted into the card connector, the stop member stops the card from entrance to further protect the terminals from damage resulted from the impact of the card.

DETAILED DESCRIPTION OF PREFERRED EMBODIMENTS

Figure 1:
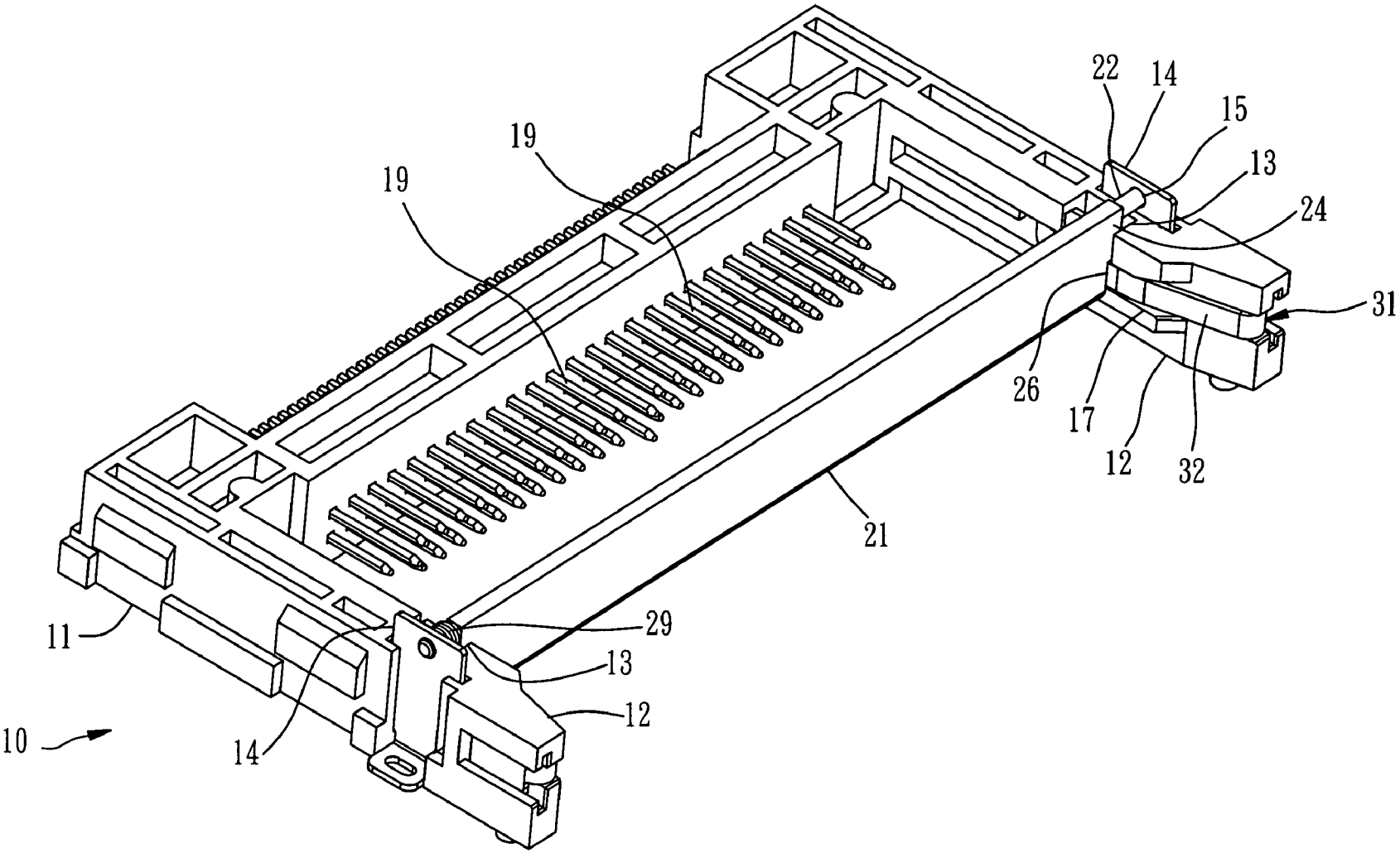
FIG. 1 is a perspective view of a preferred embodiment of the present invention.
Figure 2:
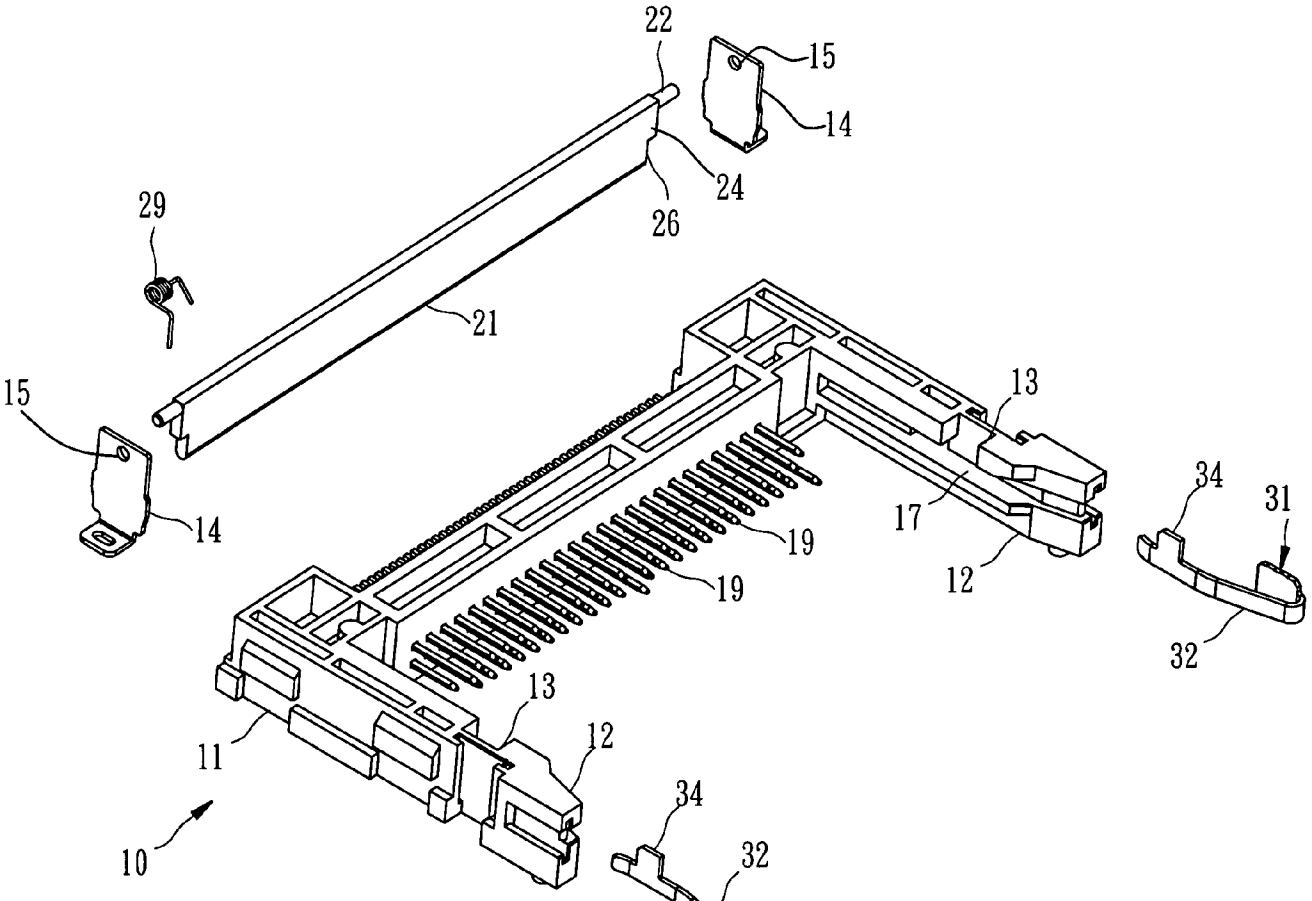
FIG. 2 is an exploded view of the preferred embodiment of the present invention.
Figure 3:
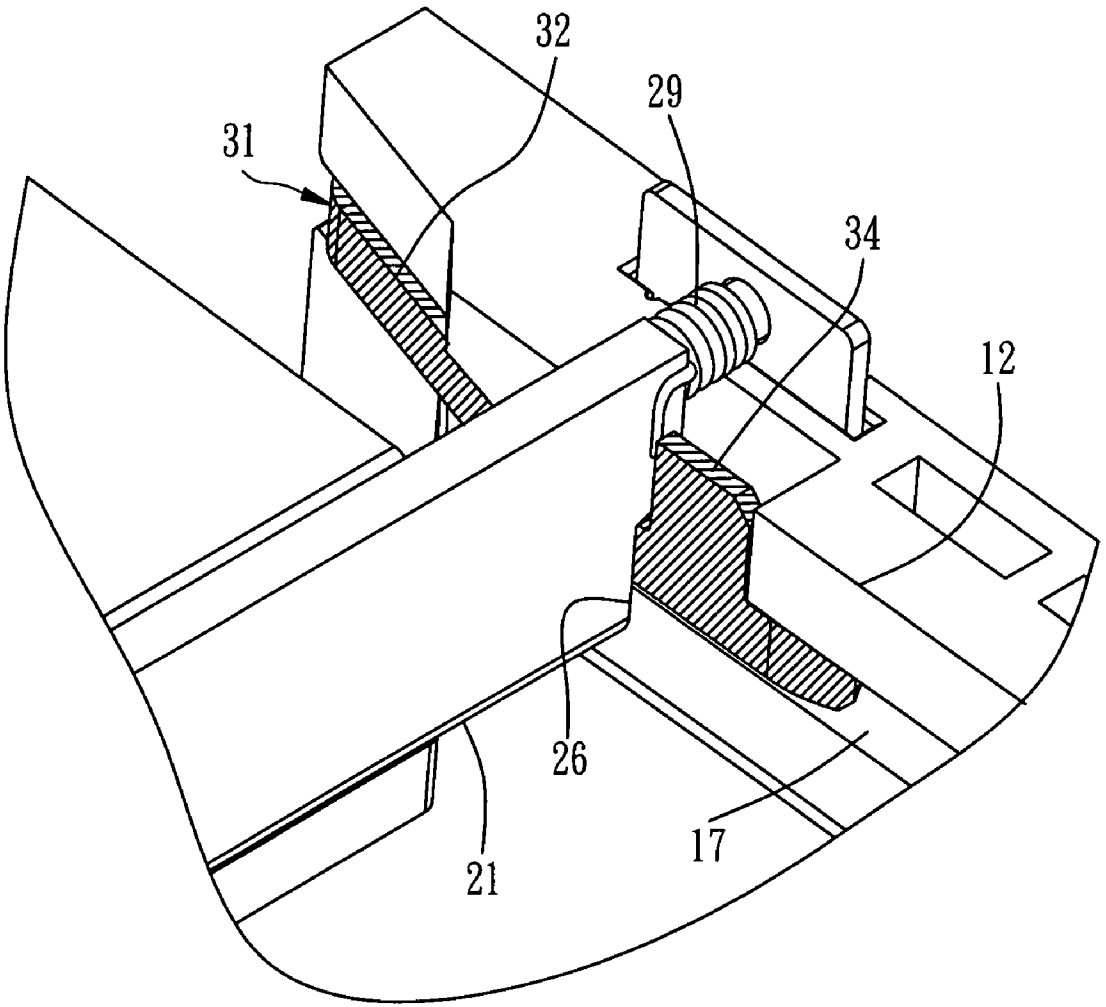
FIG. 3 is a partial enlarged view of the preferred embodiment of the present invention, showing that the retaining tongue is located at the retaining position.

Referring to FIGS. 1–3, a card connector 10 constructed according to a preferred embodiment of the present invention is comprised of a base 11, a stop member 21, an elastic member 29, and at least one retaining tongue 31.

The base 11 bilaterally includes two lateral frames 12 and a plurality of terminals 19. The two lateral frames 12 each have a rack 14 fixedly mounted thereon, a recession 13, an axial hole 15 formed on each of the racks 14, and a guide channel 17.

The stop member 21 is elongated, having two pivot axles 22 formed respectively at two ends of an upper side thereof and pivotably mounted respectively in the two axial holes 15, for pivoting movement driven by an external force between a stopping position and an entrance position. The stop member 21 further includes two blocking portions 24 formed respectively at two ends thereof and located respectively in the two recessions 13, and two depressed portions 26 formed respectively at the two ends thereof and located respectively below the two blocking portions 24.

The elastic member 29, which is embodied as a torsion spring, is fitted onto one of the two pivot axles 22 of the stop member 21 and located in the recession 13 of one of the lateral frames 12, having two ends contacting respectively against one of the blocking portions 24 and a sidewall of the recession 13, for generating resilience that keeps the stop member 21 pivoting toward the stopping position.

Figure 4:
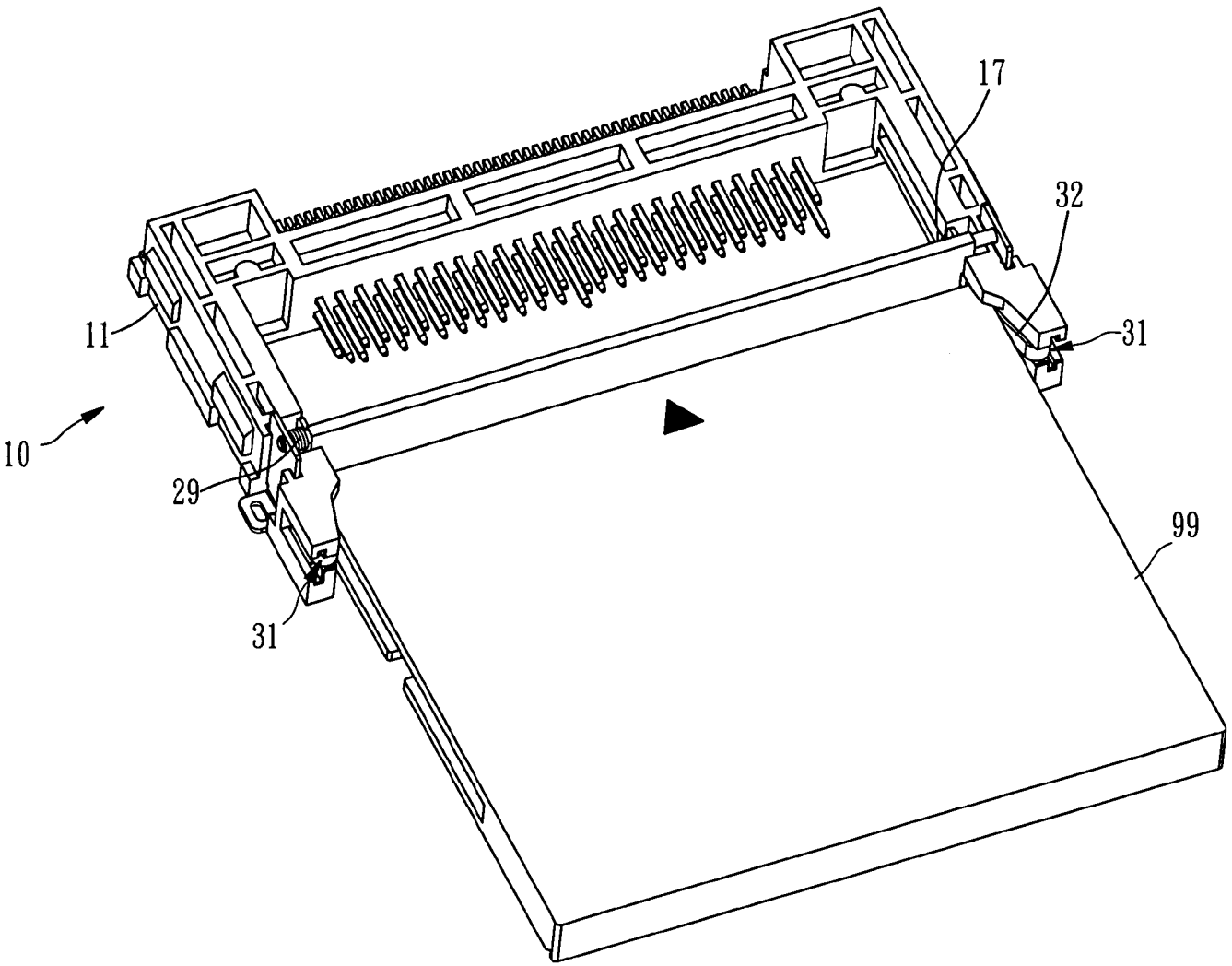
FIG. 4 is a schematic view of the preferred embodiment of the present invention, into which a card is initially inserted.

There are two retaining tongues 31 in this embodiment. Each of the two retaining tongues 31 is elongated, having one end mounted to the lateral frame 12 and partially received in the guide channel 17 and located at the depressed portion 26 of the stop member 21, and the other end thereof extending into the base 11. Each of the retaining tongues 31 has a bevel 32 slightly extending into the base 11 and slightly intercepted with a path, along which the card 99 is inserted, as shown in FIG. 4. The two retaining tongues 31 each further includes a retaining portion 34 for movement between a releasing position and a retaining position while the bevels 32 are under the insertion or extraction of the card 99.

Figure 5:
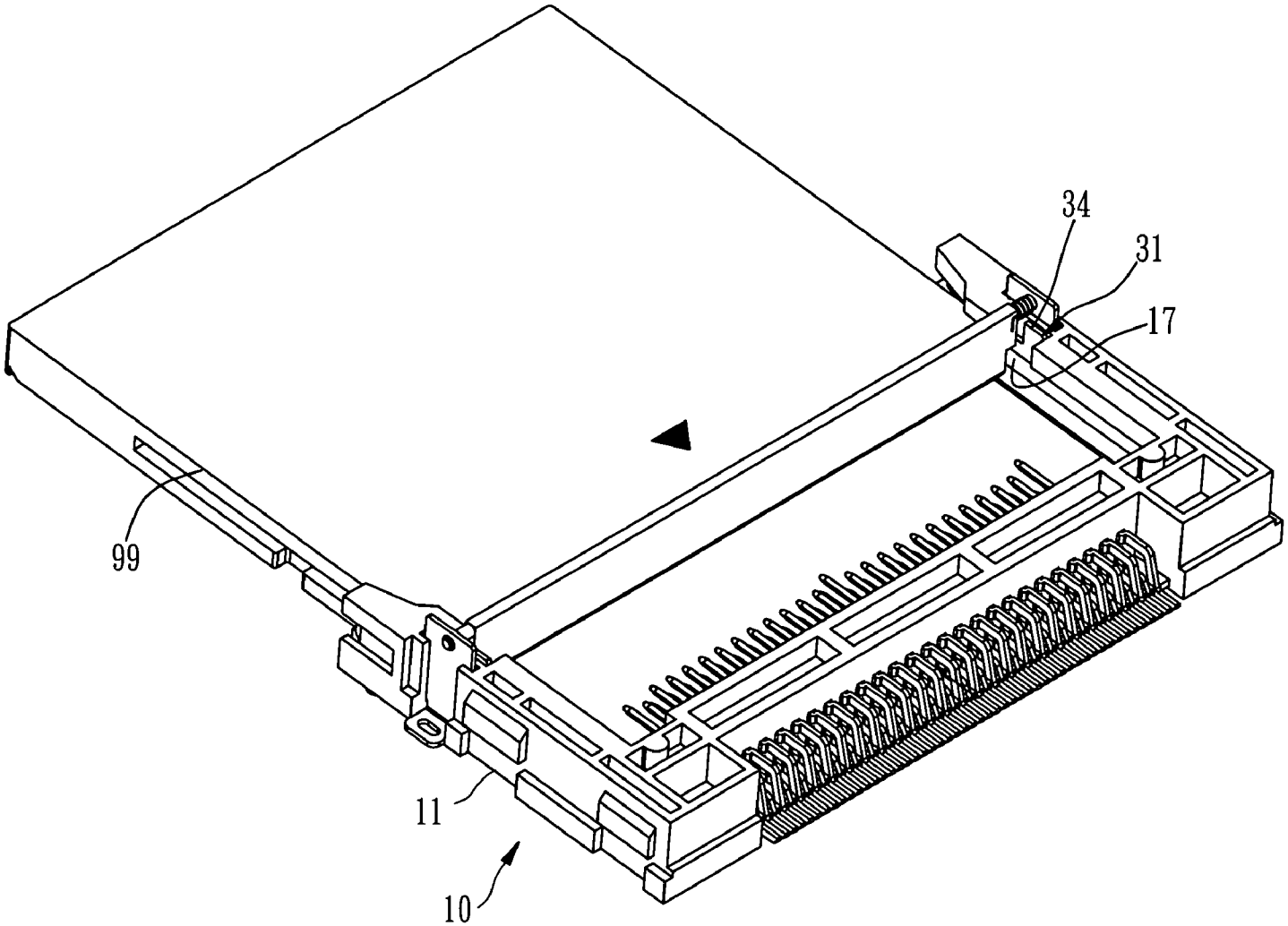
FIG. 5 is a rear view of FIG. 4.
Figure 6:
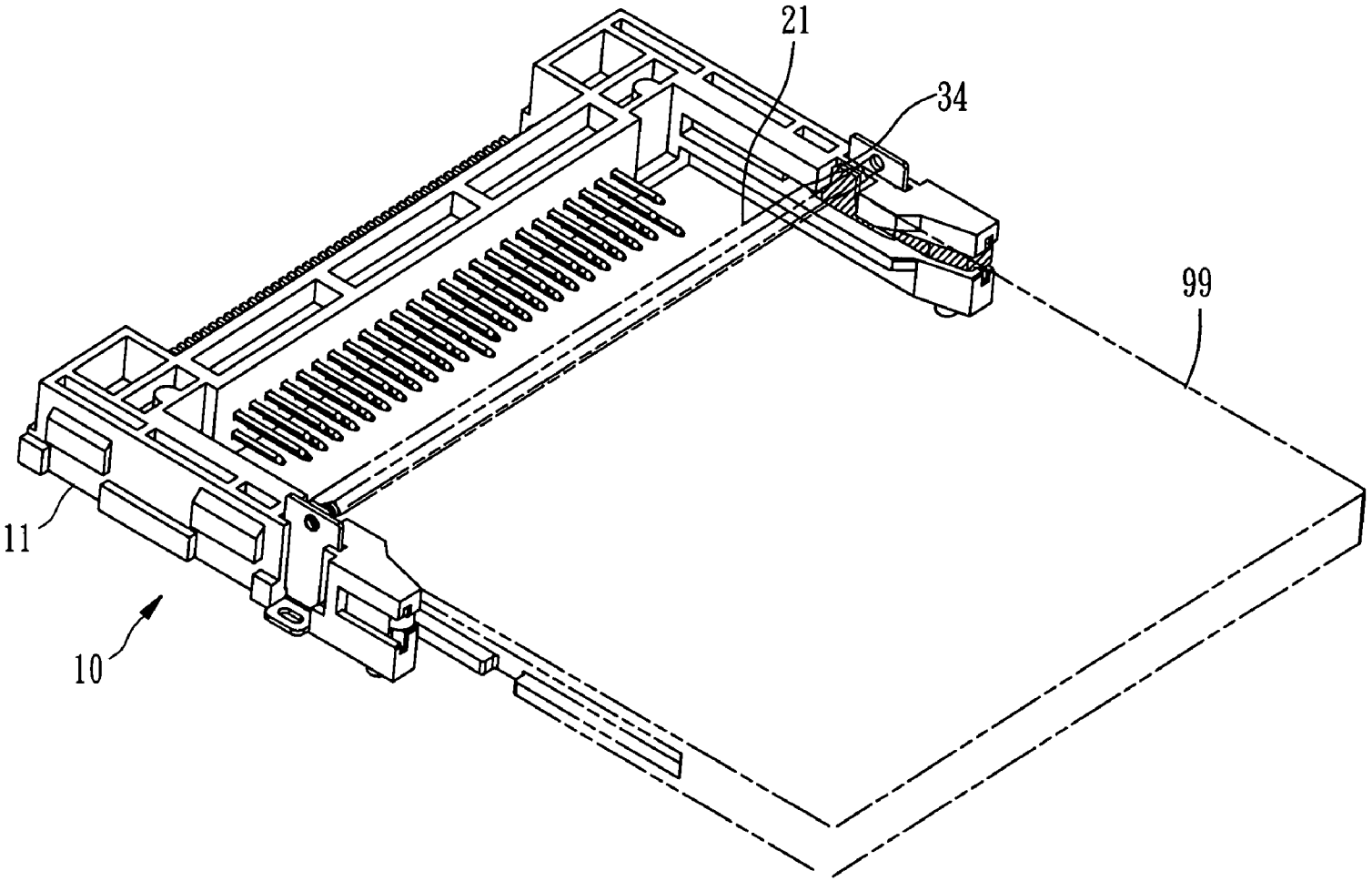
FIG. 6 is similar to FIG. 4, showing the card is pushing the stop member.
Figure 7:
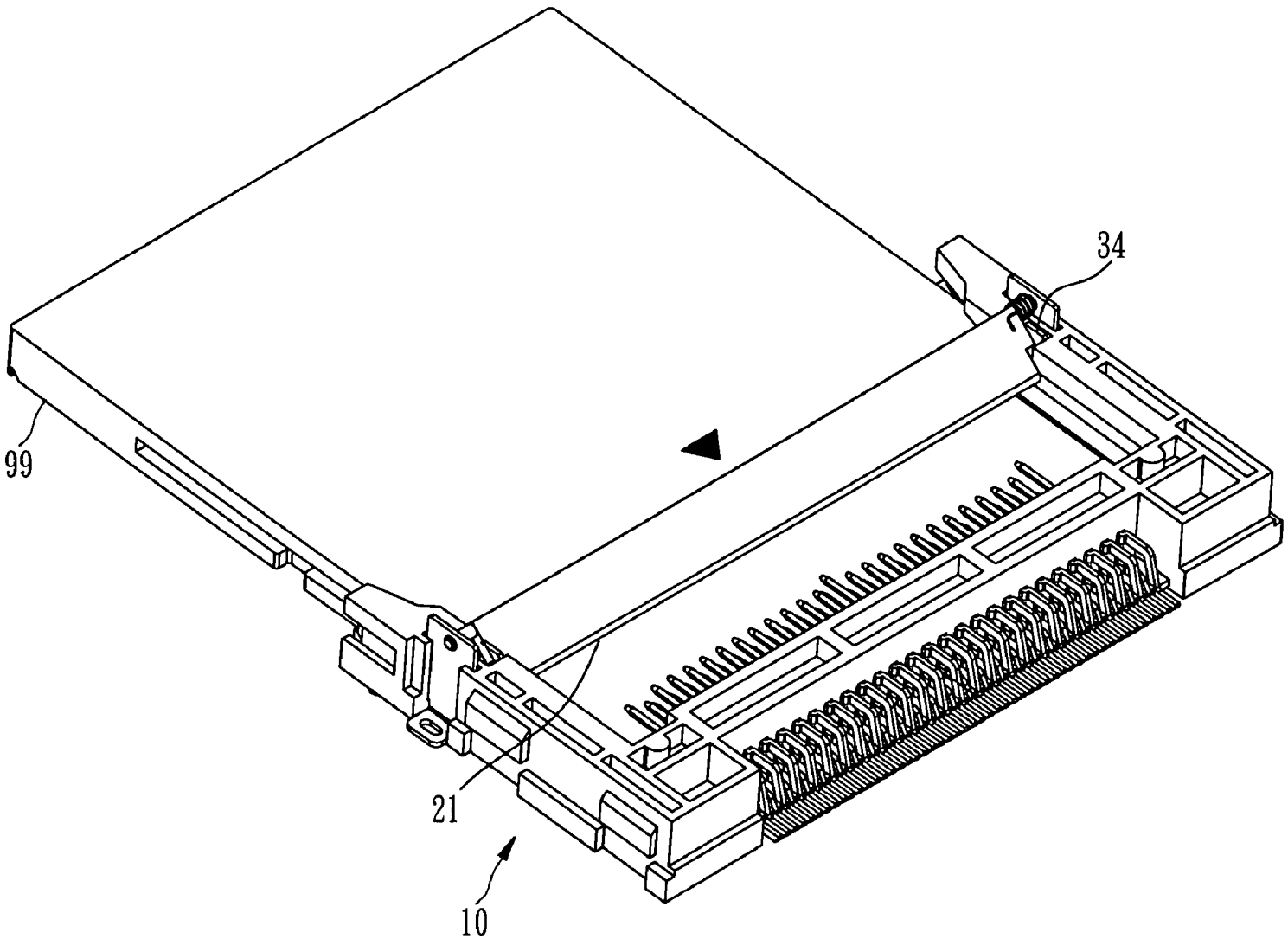
FIG. 7 is a rear view of FIG. 6.
Figure 8:
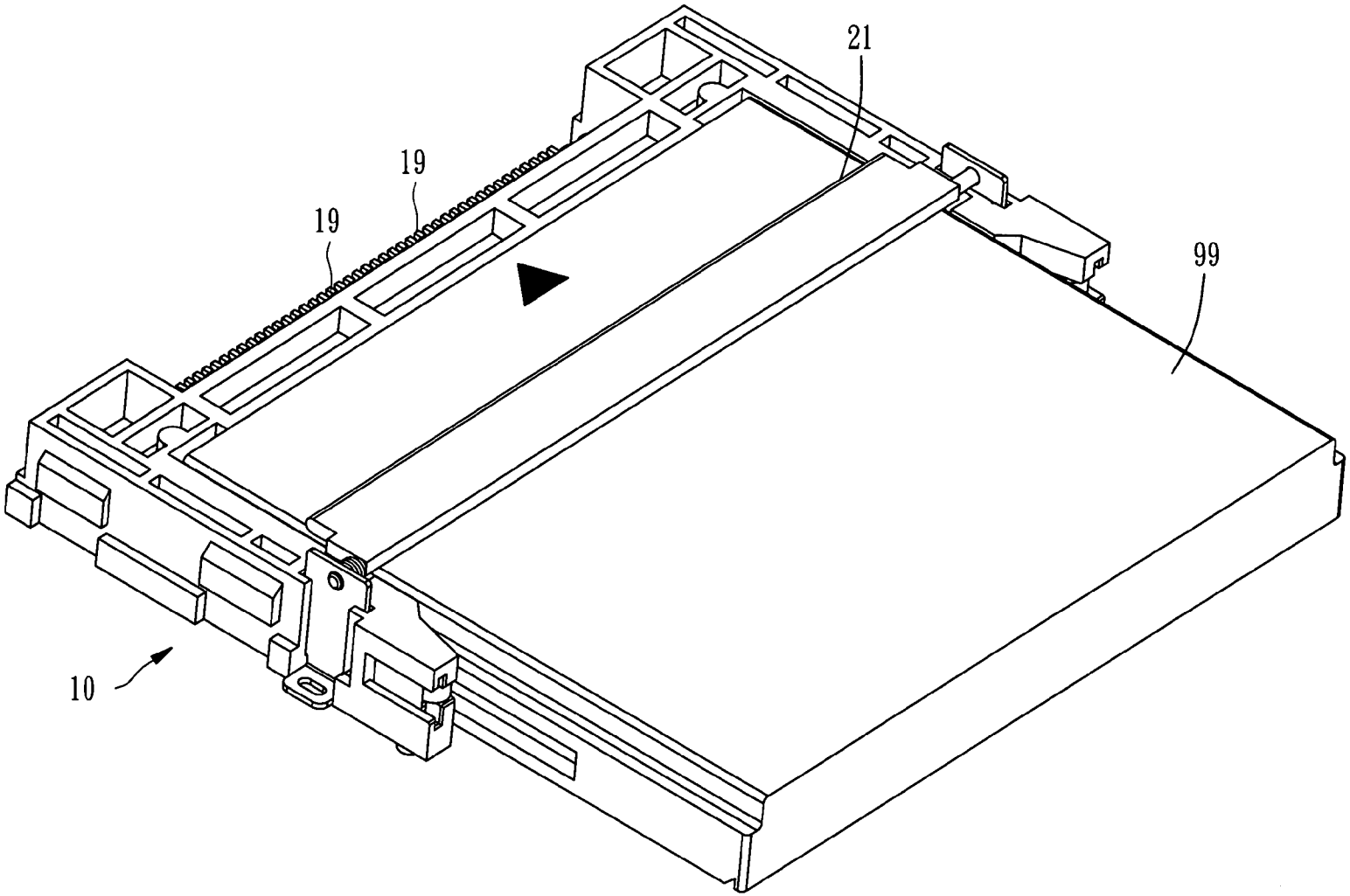
FIG. 8 is similar to FIG. 4, showing the card is fully inserted into the card connector.

Referring to FIGS. 1–3, before the card 99 is inserted into the card connector 10, the stop member 21 is forced by the elastic member 29 to contact against the sidewall of the recession 13 and the retaining tongue 31 is located at the retaining position to enable the retaining portion 34 to jam the stop member 21. While the card 99 is correctly inserted into the card connector 10, as shown in FIGS. 4–5, two front lateral sides of the card 99 work respectively on the bevels 32 of the two retaining tongues 31 to further push the two retaining tongues 31 bilaterally into the guide channels 17; meanwhile, the two retaining portions 23 are located at the releasing position. Referring to FIGS. 6–7, while the card 99 continues to enter the card connector 10, the card 99 contacts against the stop member 21 and the stop member 21 is not retained by the two retaining portions 34 to be pushed and to pivot toward the entrance position. Referring to FIG. 8, the card 99 continues to enter the card connector 10 to proceed further operations. During the extraction of the card 99 from the card connector 10 as a converse process of the insertion of the card 99 into the card connector 10, while the card 99 is moved away from the stop member 21, the stop member 21 is forced by thee elastic member 29 to pivot back to the stopping position. Next, while the card 99 continues to extract until not working on the bevels 32 of the retaining tongues 31, the retaining tongues 31 rebound to enable the retaining portions 34 to return to the retaining position as shown in FIG. 3.

Figure 9:
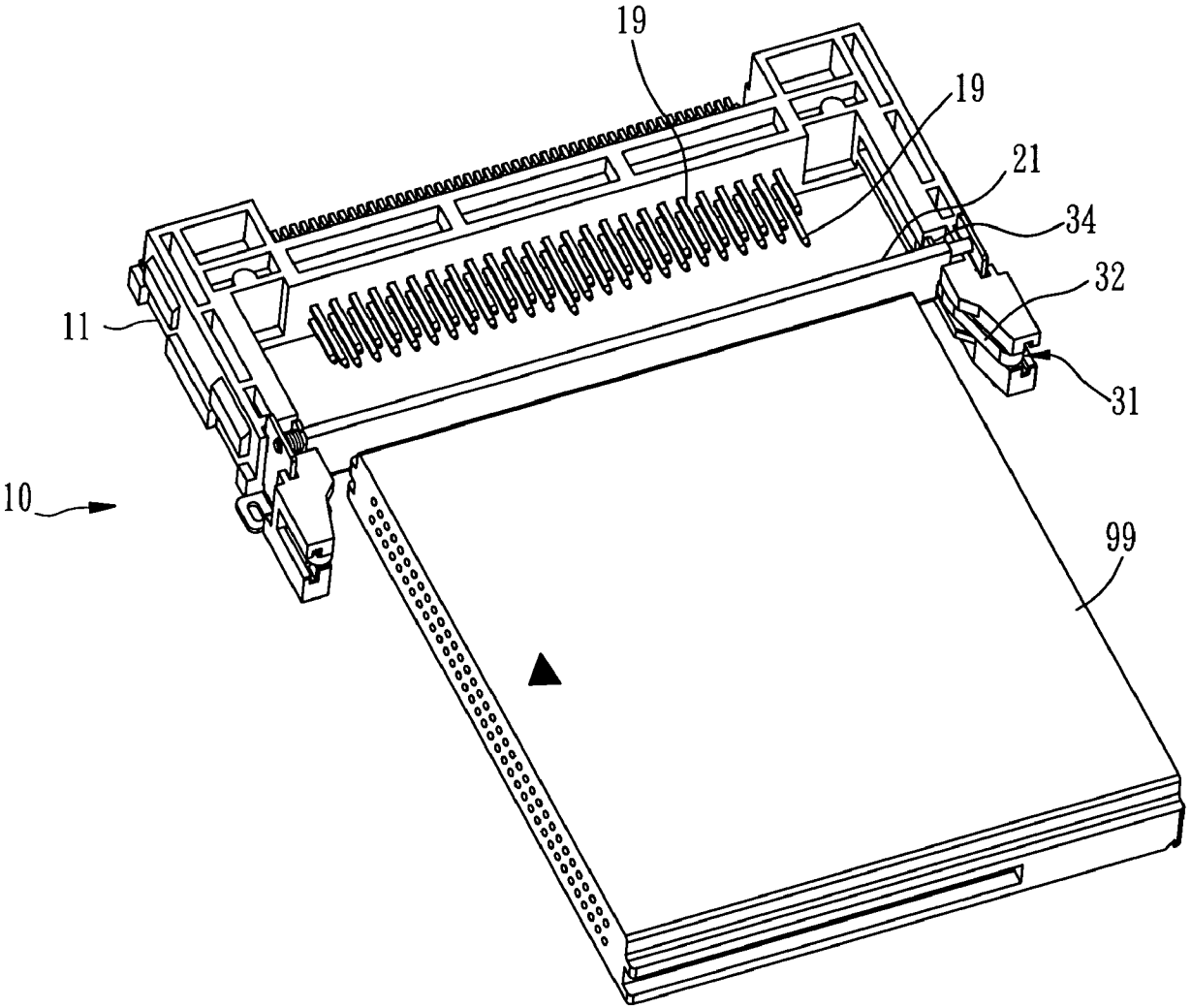
FIG. 9 is a schematic view of the preferred embodiment of the present invention, into which the card is incorrectly inserted.
Figure 10:
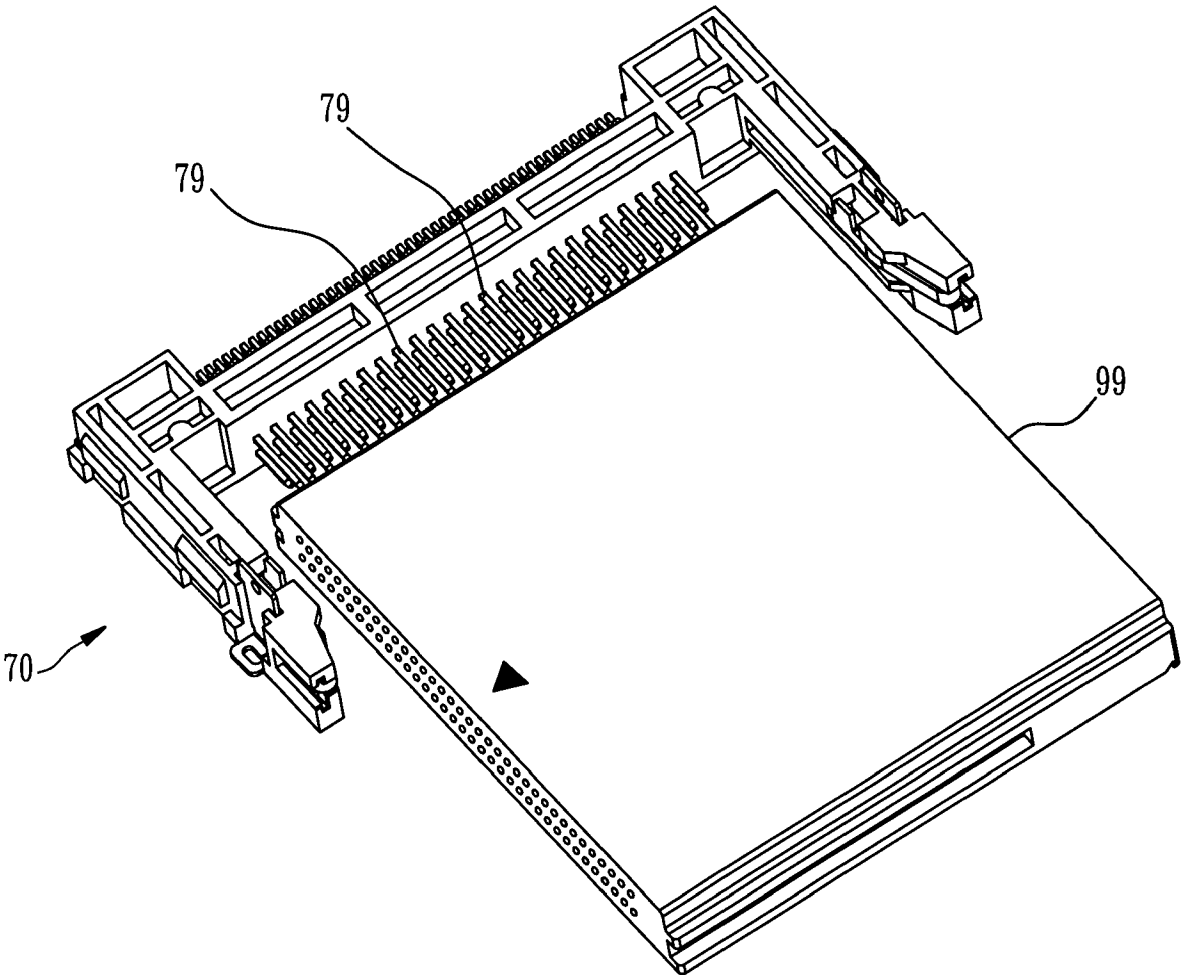
FIG. 10 PRIOR ART
FIG. 10 a schematic view of a conventional card connector, into which a card is incorrectly inserted.

Referring to FIG. 9, while the card 99 is incorrectly inserted into the card connector 10 by that, for example, the card 99 is rotated for an angle of 90°, since the access end is located at one of the two long sides of the card 99, the card 99 can still enter the base 11 but fail to work on the bevels 32 of the retaining tongues 31 because the two front lateral sides of the card 99 are shorter than the distance between the two bevels 32. In the meantime, the card 99 fails to push the retaining portions 34 to keep the retaining portions 34 at the retaining position. Next, while the card 99 continues to enter the card connector 10 to contact against the stop member 21, the stop member 21 is jammed by the retaining portions 34 not to be pushed and not to pivot toward the entrance position but to keep at the stopping position. Thus, the card 99 that is incorrectly inserted is stopped from entering the card connector 10 to avoid impacting the terminals 19.

It is to be noted that the present invention can alternatively include only one retaining tongue 31 for jamming the stop member 21 to likewise stop the card 99 from incorrect insertion into the card connector 10.

In conclusion, the present invention includes advantages of stopping the incorrectly inserted card and further protecting the terminals from damage caused by the impact of the card to secure the normal function of the card connector.

What is claimed is:

1. A card connector capable of avoiding erroneous insertion of a card, comprising:

a base having two lateral frames bilaterally and a plurality of terminals;

an elongated stop member having two ends pivotably mounted respectively to said two lateral frames for pivoting movement driven by a force between a stopping position and an entrance position;

an elastic member mounted between one of said lateral frames and said stop member for generating resilience keeping said stop member pivoting toward the stopping position; and a retaining tongue mounted to one of said lateral frames and located at one end of said stop member and having a bevel and a retaining portion, said bevel slightly extending into said base, said retaining portion being moved between a releasing position and a retaining position by said bevel under insertion or extraction of said card via said bevel.

2. The card connector as defined in claim 1, wherein one of said lateral frames comprises a recession; said stop member comprises a blocking portion located in said recession and forced by said elastic member to keep contacting against a sidewall of said recession.

3. The card connector as defined in claim 2, wherein said stop member comprises two pivot axles formed respectively at two ends of an upper side thereof; said two lateral frames comprises two axial holes, said pivot axles being pivotably mounted to said two axial holes; said elastic member is a torsion spring fitted onto one of said pivot axles and having two ends contacting respectively against said blocking portion of said stop member and the sidewall of said recession.

4. The card connector as defined in claim 1, wherein said retaining tongue is two in number and is elongated, said two retaining tongues each having two ends mounted respectively to one of said lateral frames and extending into said base.

5. The card connector as defined in claim 1, wherein said stop member comprises a depressed portion in corresponding position to said retaining tongue for receiving a part of said retaining tongue.

6. The card connector as defined in claim 1, wherein one of said lateral frames comprises a guide channel; said retaining tongue is partially received in said guide channel.

* * * * *